US005936190A

United States Patent [19]

Buzick

[11] Patent Number: 5,936,190

[45] **Date of Patent: *Aug. 10, 1999**

[54] PRECISION SHOOTING AERODYNAMIC NON-SPHERICAL SAFETY-ORIENTED PROJECTILE

[76] Inventor: Steven Craig Buzick, 17841 Welby Way, Reseda, Calif. 91335

[ * ] Notice: This patent issued on a continued prosecution application filed under 37 CFR 1.53(d), and is subject to the twenty year patent term provisions of 35 U.S.C. 154(a)(2).

[21] Appl. No.: 08/553,651

[22] PCT Filed: May 31, 1994

[86] PCT No.: PCT/US94/06054

§ 371 Date: Nov. 30, 1995

§ 102(e) Date: Nov. 30, 1995

[87] PCT Pub. No.: WO94/28371

PCT Pub. Date: Dec. 8, 1994

Related U.S. Application Data

[63] Continuation of application No. 08/139,399, Oct. 19, 1993, abandoned, which is a continuation-in-part of application No. 08/069,608, Jun. 1, 1993, abandoned.

[51] Int. Cl.[6] ..... F42B 12/40

[52] U.S. Cl. ..... 102/502; 102/513; 473/577; 473/609

[58] Field of Search ..... 102/367, 370, 102/395, 444, 498, 501, 502, 506, 512, 513, 514, 515, 516, 517, 529; 273/418, 428; 424/451, 456; 473/577, 579, 609, 218, 228

[56] References Cited

U.S. PATENT DOCUMENTS

| | | | |
|---|---|---|---|
| 1,350,828 | 8/1920 | Murray, Jr. et al. | 102/514 |
| 1,517,554 | 12/1924 | Fulcher | 102/370 |
| 3,791,303 | 2/1974 | Sweeney et al. | 102/513 |
| 3,861,943 | 1/1975 | Grainger | 117/37 |
| 4,634,606 | 1/1987 | Skogg | 102/502 |
| 4,656,092 | 4/1987 | Haman et al. | 102/502 |
| 4,686,905 | 8/1987 | Szabo | 102/444 |
| 4,819,562 | 4/1989 | Bowman | 102/281 |
| 4,899,660 | 2/1990 | Brighton | 102/444 |
| 5,035,183 | 7/1991 | Luxton | 102/502 |
| 5,058,503 | 10/1991 | Adams | 102/501 |
| 5,164,538 | 11/1992 | McClain, III | 102/517 |
| 5,254,379 | 10/1993 | Kotsiopoulos et al. | 102/502 |
| 5,353,712 | 10/1994 | Olson | 102/513 |

*Primary Examiner*—Harold J. Tudor
*Attorney, Agent, or Firm*—Lawrence S. Cohen, Esq.

[57] ABSTRACT

An improved, precision shooting, safety oriented, high speed projectile (10) comprising a non-toxic, soft, hollow, capsule (12) formed of a plurality of portions joined together at at least one seam line (14), said seam line (14) being the weakest point of the capsule (12), with the greatest length of the capsule (12) alignable along the length of a gun barrel, whereby said capsule (12) will generally consistently impact on an essentially predetermined portion of the capsule (12) relative to the centerline of the initial direction of flight of the capsule and a colored, non-toxic, fill material disposed in said capsule (12) for ejection therefrom, the angle of at least one seam line (14) being generally consistent relative to the centerline of the initial direction of flight, upon rupture of said capsule (12) at at least one seam line (14) upon impact of said projectile (10) on a soft solid target. The capsule (12) is preferably elastic gelatin.

67 Claims, 2 Drawing Sheets

PRECISION SHOOTING AERODYNAMIC NON-SPHERICAL SAFETY-ORIENTED PROJECTILE

This application is a continuation of prior application U.S. Ser. No. 08/139,399, entitled "Precision Shooting Aerodynamic Non-Spherical Safety-Oriented Projectile", filed Sep. 10, 1993, now abandoned, which is a continuation in part from application U.S. Ser. No. 08/069,608, entitled "Precision Shooting Aerodynamic Non-Spherical Safety-Oriented Projectile", filed Jan. 6, 1993, now abandoned.

BACKGROUND OF THE INVENTION

1. Field of the Invention

This invention generally relates to projectiles and more particularly relates to a novel, precision shooting, aerodynamic, non-spherical, safety-oriented projectile comprising a non-toxic, soft, elastic gelatin, usable for police activities, mock hunting, games, sports, military activities, and the like including but non-limited to those commonly referred to as Paintball, Adult War Games, Adventure Games, Action Pursuit Games, etc.

2. Description of the Prior Art

The use of spherical and non-spherical metallic and/or rubber/plastic projectiles, for the purpose of causing bodily harm or impairment to human beings and/or animals, in a variety of guns is well known. The use of such metallic, and/or rubber/plastic projectiles/bullets presents inherent safety problems and risk of bodily harm and/or impairment when such projectiles are deliberately fired at people or animals in activities such as, but not limited to, Adventure Games, police training, military exercises, mock hunting, sports, and games. Use of known metallic and/or rubber/plastic projectiles/bullets can also substantially and unacceptably damage the general environment.

The use of a soft gelatin capsule in a method for marking trees with a marking fluid has been described in U.S. Pat. No. 3,861,943. According to that description the gelatin capsule has a wall thickness from 0.02 inches to 0.03 inches and a diameter of 0.25 inches to 0.75 inches. The capsule contains from 0.25 cc to 1.25 cc of marking fluid, generally a pigmented liquid such as an oil-based paint, or the like, useful for marking stationary articles, such as trees. However, this marking capsule would present certain disadvantages in other applications, such as projectiles for Adventure Games. In particular, the amount and/or type of fluid in the capsule inhibit precision shooting, due to the fact that the shape of the capsule is based on the amount of fluid contained therein. As a result, the capsule generally is unacceptably inaccurate for precision shooting. It operates at velocities of 50 to 200 feet per second and cannot be used for anything other than very short range shooting with any degree of accuracy, whereas Adventure Games activities need a much greater accuracy range, are often shot at smaller targets, which often move, and often shoot back, while operating at velocities preferably about 250 feet per second to about 325 feet per second with potentially higher velocities involved in the mock hunting activity. If such capsules containing indelible fluids were used in Adventure Games the resulting staining would be difficult or impossible to wash clean from clothing, buildings, or the accessible general environment. Also, such breakage, when applied to Adventure Games or mock hunting, present a very high possibility of accidental ingestion by a human being or deliberate ingestion by a animal that could be chemically harmful to the human or the animal. Moreover, breakages of the capsules containing indelible fluids would be harmful to the environment and protected trees, such as Oak trees.

The use of a soft gelatin capsule containing marking fluid in a marking method for target shooting on a stationary non-soft target or the like has been described in U.S. Pat. No. 4,696,092. According to that description, a target shooting capsule is used which comprises a substantially spherical, non-toxic, soft, elastic, seamless gelatin capsule having a dry wall thickness of about 0.004 inches to about 0.013 inches, having a diameter of about 0.16 inches to about 0.265 inches, and containing about 0.03 cc to about 0.12 cc of a water-washable, non-toxic, dye fill material. The substantially spherical capsule was designed and intended to impact on a relatively non-soft, solid, and stationary target. However, the substantially spherical capsule has certain disadvantages in other applications such as Adventure Games. In particular, it would have to be fired at a much higher velocity in order to break upon and mark a soft solid target, such as a human or animal, because the force needed to break the seamless capsule is much greater than that required to break a multi-piece seamed capsule. As a result, the substantially spherical capsule could cause unacceptable bodily harm and/or impairment to a human or animal. Moreover, a substantially spherical capsule is generally not spin stable and therefore inaccurate when compared to an aerodynamic, non-spherical, spin stable, projectile.

There exists today in the public domain a substantially spherical capsule utilized primarily, but not exclusively, for Adventure Games. This gelatin capsule has a wall thickness of about 0.010 inches to 0.020 inches with a diameter of about 0.500 inches to about 0.700 inches and is substantially spherical. This substantially spherical capsule being manufactured with a diameter of approximately 0.500 inches, 0.620 inches and 0.680 inches with the disadvantages and advantages of each hotly disputed within the industry, both verbally and in print. The 0.680 inch diameter is today the principal capsule of choice in practice. This substantially spherical capsule consists of two gelatin strips connected together by a rotary die process, which results in the substantially spherical capsule having a seam and containing a non-toxic dye fill material which is water washable.

This substantially spherical capsule has serious disadvantages because it is substantially spherical. In particular, because the substantially spherical capsule is fed into a gun primarily by a gravity feed method, there is no way to consistently control the positioning of the seam in the gun barrel. As a result, not only will the substantially spherical capsule generally strike the soft solid target randomly with respect to the seam, it may not strike the soft solid target with any portion of the seam at all. The seam is the weakest part of the substantially spherical capsule and almost all breakages of the substantially spherical capsule, as a result of impact on a soft solid target, first occur somewhere on or along the seam line. Consequently this requires that the capsule be consistently fired at a greater velocity in order to cause a break on the seam line of the substantially spherical capsule without the necessity of impacting on the seam line, which in a safety oriented recreational activity such as Adventure Games is a very undesirable condition.

As another result of not impacting primarily on the seam line, if at all, the substantially spherical capsule will quite often simply bounce off the soft solid target without breaking. If the activity is Adventure Games and the soft solid target is an opposing player and the substantially spherical capsule bounces off this player, this results in the player that was impacted not being called out of the game even though the players, because of the impact, might think this is the case. This can cause confusion, bad feelings, and arguments and necessitates that the player must be shot again to achieve the necessary mark in order to remove said player from the game. Such is an unsafe and undesirable result to the shooter, shootee, and the playing arena owner who may assume liability for the activities to some extent.

Accuracy of the substantially spherical capsule is generally inconsistent because the capsule generally does not rotate/spin about an axis along the direction in which the substantially spherical capsule is traveling and because the capsule is commonly fired from a smooth barrel it tends to develop a spin/rotation. Even given the condition that would cause the substantially spherical capsule to consistently spin/rotate about an axis along the direction in which the substantially spherical capsule is traveling, the random placement of the seam could, in flight, tend to cause frictional force which is asymmetric, relative to the direction of motion, at the seam line because the seam line would not consistently be either parallel to or perpendicular to the initial direction of flight, resulting in loss of shooting accuracy. Manual placement of the substantially spherical capsule would defeat the purpose of pump action and semi-automatic action guns which dramatically dominate the marketplace. Manual placement would still, if attempted, present inherent placement accuracy problems based on human error and even then the substantially spherical capsule would tend not to consistently maintain this alignment relative to the centerline of the initial direction in flight. This resulting inaccuracy of the substantially spherical capsule is common and undesirable.

The substantially spherical capsule tends not to leave a consistent mark on soft solid targets such as a human or animal body. Because of the seam's random position upon impact, the marking capability of the substantially spherical capsule can be anywhere from near zero to near maximum, inasmuch as the marking fluid will tend to be expelled though the seam first, which is frequently not in the direction of flight. This causes part or all of the marking fluid to have its destination at places other than the point of impact. This is undesirable when applied to Adventure Games in that certain size marks, depending upon the playing arena, are required to remove the player from the game. Furthermore, the mark left on the player is not required to be circular, simply the required size when considered in total, at the primary point of impact and marks not at the primary point of impact are not considered into the total mark size.

Accordingly, there has been a felt but unfulfilled need for a precision shooting, aerodynamic, non-spherical, safety oriented projectile which shoots reliably, requires less initial velocity than that of a comparable substantially spherical capsule of approximately the same mass, weight and volume to travel the same distance, and will generally impact on the same portion of the projectile and in generally the same manner for uniformity in marking the target upon impact, with improved spin stability, safety, and accuracy. Moreover, the projectile should be inexpensive and easy to use and be accurate to shoot, even at comparatively long range.

SUMMARY OF THE INVENTION

The improved precision shooting, aerodynamic, non-spherical, safety oriented projectile of the present invention satisfies all the foregoing needs.

The invention provides a precision shooting aerodynamic non-spherical safety oriented projectile comprising a non-toxic, soft, aerodynamically shaped, hollow, non-spherical, high speed capsule of elastic gelatin or the like, with a non-toxic, water washable, colored fill material disposed in the hollow interior thereof. The capsule comprises two or more portions joined at one or more easily rupturable seam lines, with the capsule's longest length being along the length of a gun barrel. The gelatin capsule is consistently accurately and substantially filled but need not be entirely filled with the colored non-toxic fill material, but is generally uniform from capsule to capsule in size, shape, quantity of colored non-toxic fill material the soft elastic gelatin capsule of the invention is fabricated by the current state of the art rotary die process of the type employed to make vitamin, such as vitamin E, and medication capsules.

The precision shooting aerodynamic non-spherical safety oriented projectile is comparable aerodynamically to non-spherical metallic and/or rubber/plastic projectiles for improved accuracy and decreased frictional force while in flight.

In particular embodiments, the projectile may be configured in the form of a pointed cylinder, i.e. bullet-shaped; in other embodiments the projectile may have at least two seams, in some applications substantially perpendicular to one another. Other embodiments of the invention include dual pointed generally cylindrical, generally oval and generally ellipsoidal configurations.

DETAILED DESCRIPTION OF THE INVENTION

Figure 1:
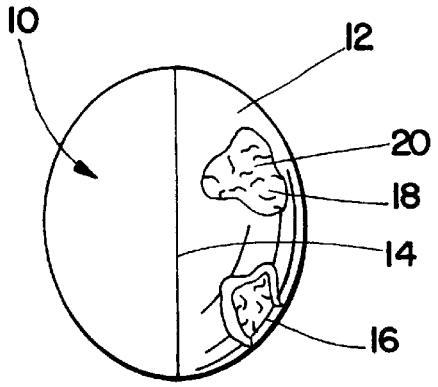
FIG. 1 is a top plan view, somewhat schematic and partly broken away, of an embodiment of the improved projectile of the present invention.

Referring more particularly to FIG. 1, a first embodiment of the improved, precision shooting, aerodynamic, non-spherical, safety oriented, non-toxic projectile, hereinafter referred to as the "improved projectile", of the present invention is schematically depicted therein. The improved projectile 10 is specially adapted for, but not limited to, safe use in games, military activities, police activities, mock hunting and sports, particularly those in which the improved projectile is to be fired at, hit, and mark soft solid targets such as humans or animals. One such sport is called Adventure Games, the object of which is for a player to eliminate opposing players from the game by striking them with a marking projectile shot from a gun.

Improved projectile 10 comprises a soft, hollow, non-toxic capsule 12 of elastic gelatin or the like, where capsule 12 is non-spherical, its greatest length being alignable along a gun barrel's length (not shown). Capsule 12 comprises preferably, but is not limited to, two portions joined together at seam line 14, preferably centered, disposed on the length of capsule 12. The capsule 12 preferably has a length substantially equal to 10 percent to 166 percent greater than the greatest width.

Improved projectile 10 is non-toxic and contains a water washable colored fill material that is non-toxic. As will be apparent from the detailed description below, the improved projectile 10 has the advantage of consistently predetermining, without direct manual placement, the angle of the seam(s) in the gun barrel in relation to the centerline of the initial direction of flight whether fed into the gun by gravity, pressure, spring, or hand. As a result, improved projectile 10 can: 1. consistently impact primarily on, adjacent or along its weakest portion, which is seam line 14, thereby substantially promoting safety interests which is highly desirable. 2. consistently impact primarily on or along its weakest portion, which is seam line 14 whereby it is more likely to burst resulting in bounces off the soft solid target without breakage. 3. consistently impact primarily on, adjacent or along seam line 14 whereby the marking capability of improved projectile 10 is not only rendered consistent but the mark will generally be substantial. 4. achieve superior accuracy because a consistent and stable spin can be achieved about the longest axis resulting in superior flight stability and in some applications making the effect of an asymmetric seam line negligible for practical purposes. 5. have superior or equal distance capability with lower muzzle velocity for additional safety or will provide greater distance shooting without essentially changing safety requirements. 6. as a result of seam line 14 being placed in the plane of the initial direction of flight of the improved projectile, any frictional force will have negative effect on accuracy. 7. eliminate the tendency to roll forward into the barrel resulting in double feeding which could cause bursting of the capsules in the barrel. 8. have a seam line generally perpendicular to the initial direction of flight, with seam line 14 removed, whereby any frictional force caused by seam line 14 is relieved. 9. have at least one crease, ridge, or score line generally perpendicular or generally parallel or otherwise to the centerline of the initial direction of flight, in addition to seam line 14, whereby breakage of the projectile is facilitated. 10. by forming the front of improved projectile 10 to a point, rounded or otherwise, gyroscopic properties are achieved providing superior flight stability and accuracy.

Capsule 12 can vary in size and shape, as desired, in accordance with the invention. Capsule 12 is generally ellipsoidal. In FIG. 1, the greatest width of capsule 12 being preferably substantially equal to 0.300 inches to 0.750 inches, the length of capsule 12 being preferably substantially equal to 0.400 inches to about 2.000 inches long. Capsule 12 comprises a shell or wall 16 defining a hollow interior space 18. Preferably wall 16 has a substantially uniform thickness of 0.004 inch to 0.030 inch and within space 18 that colored non-toxic fill material 20 of improve projectile 10 is disposed. Wall 16 preferably has wall thickness of 0.004 to 0.019 inch for Adventure Game use and for mock hunting applications involving small or fragile targets, such as rabbits. Larger wall thicknesses are usable in applications, such as mock hunting involving large or sturdy animals, where harder impacts are not undesirable a wall thickness of 0.02 inch to 0.03 inch being preferred. The thicknesses given are dry wall thickness i.e. thickness of the walls when they are dry after manufacturing. Because rupture occurs at, adjacent or along the seam line, the wall thickness in this region is of primary import. Capsule 12 can be formed by a conventional processing technique commonly referred to as the rotary die process, such as is used to fabricate capsules of vitamins or medications. The process may proceed from any suitable mixture of materials, such as, for example, those described in the following description. A brief description of this conventional rotary die process will suffice. The basic ingredients of the capsule 12 shell portions comprise primarily gelatin with other various ingredients to achieve the desired gelatin composition. Preferably used preservatives are methyl and propylparabens and sorbic acid. Certified dyes are preferably used when color is desired. Titanium Dioxide is preferably used to produce opaque capsules. The variety of colors that can be opaque or transparent are colored transparent, colored opaque, natural transparent, two-tone opaque, two-tone transparent and two-tone transparent opaque. Random camouflage patterns consisting of two or more colors can be induced by combining the melted gelatin in the final encapsulation tank and stirring it slowly and/or infrequently. Flavoring agents, including but not limited to Ethyl Vanillin, Essential Oils, or Methionine, and/or scent agents, may also be employed in the capsule shell and/or fill material. Following a basic pre-determined formula the gelatin and other ingredients are mixed and melted in large stainless steel vacuum melters located on an elevated platform above the preparation room. This elevation permits gravity feeding into the stainless steel receiving and transfer tanks, which are water jacketed for heating purposes to maintain the gelatin temperature within required tolerances. Appropriate dyes and/or titanium dioxide can be added in the transfer tanks, if required, for coloring purposes. Both the viscosity and temperature of the gelatin must be held within relatively narrow specifications to insure quality manufacturing. All fill material ingredients, both solids and liquids are pre-weighed and transferred to stainless steel blending tanks where they are adequately mixed to obtain a uniform product. The mixing is accomplished through the use of (variable) mixers If necessary, the mixture is put through a homogenizing process which breaks up agglomerates of solids and insures that all solids are wet with the liquid base. Again, if required the mixture is deaerated and transferred into stainless steel tanks ready for encapsulation. Two transfer tanks, one containing gelatin and the other the non-toxic colored fill material are hung over the soft capsule machine. A continuous flow of gelatin is supplied to a metering device and thus metered onto air cooled rotating drums forming a gelatin ribbon. These two ribbons of gelatin roll down between the rotary dies, becoming taut and somewhat stretched. A continuous flow of the non-toxic colored fill material is supplied to a displacement pump which controls the fill weight of the capsule be produced. When the capsule is approximately half formed, the non-toxic colored fill material is literally exploded through orifices in a heated wedge segment to force the gelatin ribbon into the die pockets where capsules are simultaneously shaped, filled, hermetically sealed and cut from the gelatin ribbons. Regular monitoring of fill weights, seal thickness, uniformity of shape and general appearance is carried out during the encapsulation process. If required, the freshly formed capsules are conveyed to a washer. After washing to remove any oil residues the capsules are transferred to tumbler driers for initial drying. As capsules are discharged from the drier they are spread on shallow trays and moved into a drying room to complete the drying process. After completion of drying the capsules may be washed and cleaned using a solvent and centrifuge equipment. The capsules are then examined for visual defects such as poor seals, poor uniformity of shape, leaking capsules or other defects. They may also be processed through sizing equipment to sort out any under or oversided capsules. Using statistically reliable sampling techniques quality control personnel verify the physical standards of size, shape, color, weight, moisture content and seal integrity. The capsules are then released for counting, packaging and shipment. By this process projectile 10 is accurately filled, i.e. within relatively narrow tolerances.

Fill material 20 is non-toxic, water washable, of conventional type and is of a variety of colors, including black and white, preferably colors that show up well on various camouflage clothing or animal skin/fur. Fill material 20 may also contain flavoring and/or scent agents. The description hereinabove describes an example of how fill material 20 is created. Ingredients should not be used in fill material 20 which could not be washed from the clothing or skin of humans and/or animals or the general environment that is accessible to washing. Therefore, oil-base pigments and initially water soluble paints which set to a water insoluble state, for example so called tempera paints preferably should not be used in fill material 20.

The amount of fill material 20 in capsule 12 will vary, depending on the size of capsule 12. Capsule 12 need not be entirely filled with fill material 20, but only that, for maximum shooting accuracy, a plurality of capsules 12 be substantially identical to each other in size, shape and weight and have about the same volume of fill material 20 therein. Typically, fill material 20 will be present in capsule 12 in an amount preferably substantially equal to 0.011 cubic inches to 0.347 cubic inches. That is generally sufficient, although visibility and weight requirements may vary depending on the activity and target, to mark a soft solid target, such as a human or animal, impacted by improved projectile 10.

Improved projectile 10 is loadable into a gun barrel (not shown) so that seam line 14 extends along the length of the gun barrel. Capsule 12 is sized with respect to the gun barrel so that it can fit into the barrel only this way. That is, capsule 12 at its greatest length will not fit into the barrel sideways, but the greatest width of capsule 12 is such that capsule 12 is slidingly received in the gun barrel. Since each capsule 12 is essentially uniform in fill and stable in dimensions it is loadable the same way into the gun barrel. The portion of capsule 12 that impacts the soft solid target is generally consistent relative to the centerline of the initial direction of flight and the angle of seam line 14 relative to the centerline of the initial direction of flight is generally consistent upon impact of a soft solid target. Capsule 12 will generally retain these alignments while in flight because capsule 12 is substantially spin stable. When improved projectile 10 impacts upon a soft solid object such as a human or animal, it will generally break first at, adjacent or along seam 14 making the desired mark while promoting safety interests.

Improved projectile 10, although soft with elastic properties, essentially will retain its shape when fired from a gun or the like, and is still strong enough not to accidentally rupture, under normal use, in the gun barrel. Improved projectile 10 is inexpensive to make, relatively easy to store and has superior aerodynamic, safety, marking, and accuracy properties which make it highly desirable for use in Adventure Games, among other activities.

Figure 2:
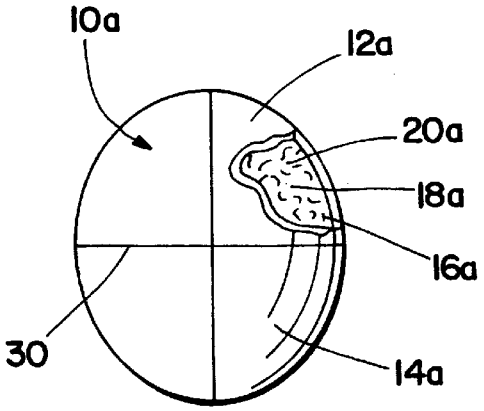
FIG. 2 is a top plan view, somewhat schematic and partly broken away of an alternative embodiment of the invention.

A second embodiment of the improved projectile of the present invention is schematically depicted in FIG. 2 as improved projectile 10*a*. Components thereof similar to those of improved projectile 10 of FIG. 1 bear the same numerals but are succeeded by the letter "a".

Improved projectile 10*a* is identical to improved projectile 10, except that projectile 10*a* has an additional seam line 30 perpendicular to the longest axis of improved projectile 10*a* and designed to further facilitate breakage of improved projectile 10*a* when it hits a soft solid target. Improved projectile 10*a* has the other advantages of improved projectile 10.

Figure 3:
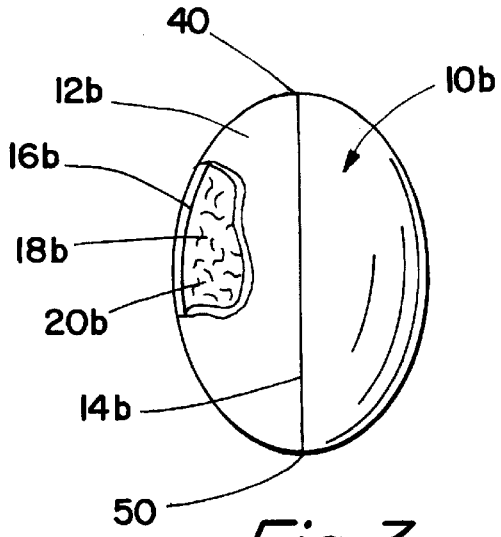
FIG. 3 is a top plan view, somewhat schematic and partly broken away, of an preferred embodiment of the invention.

A preferred and third embodiment of the improved projectile of the present invention is schematically depicted in FIG. 3 as improved projectile 10*b*. Components thereof similar to those of improved projectile 10 bear the same numerals but are succeeded by the letter "b".

Improved projectile 10*b* is identical to improved projectile 10, except that projectile 10*b* has a pointed front end 40 and a pointed rear end 50 in which seam line 14*b* is disposed, for easier loading into ammo containers, or the like, and a greater gyroscopic effect thereby promoting additional accuracy. Improved projectile 10*b* has the other advantages of improved projectile 10.

Figure 4:
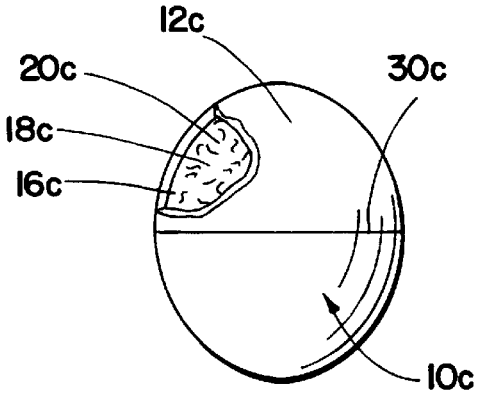
FIG. 4 is a top plan view, somewhat schematic and partly broken away, of a further alternative embodiment of the invention.

A fourth embodiment of the improved projectile of the present invention is schematically depicted in FIG. 4 as improved projectile 10*c*. Components thereof similar to those of projectile 10*a* bear the same numerals but are succeeded by the letter "c".

Improved projectile 10*c* is identical with projectile 10*a*, except on the longest axis seam line 14*a* is missing from projectile 10*c*, which, however, does have seam line 30*c* which is generally perpendicular to the longest axis whereby any frictional force that may be caused by seam line 14*a* is relieved.

It will be understood that, if desired, at least one score, seam, ridge, or crease line could be used in addition to the described seam lines, to facilitate flight stability and/or rupturing of the improved projectile on impact with a soft solid target, in accordance with the invention.

Figure 5A:
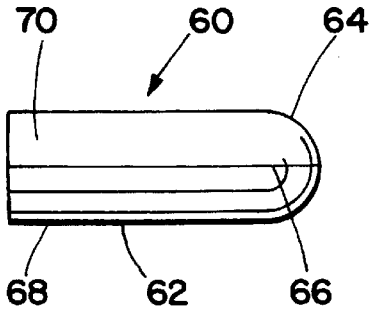
FIG. 5A shows a cylindrical capsule having one rounded end.
Figure 5B:
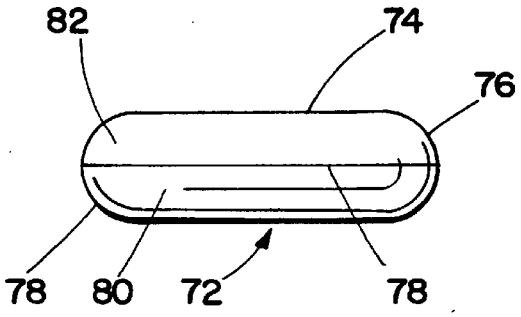
FIG. 5B shows a cylindrical capsule having two rounded ends.

FIG. 5A shows a capsule 60 having a cylindrical portion 62 and a rounded end portion 64 at one end and a seam 66 extending around the capsule to join the two portions 68 and 70. FIG. 5B shows a capsule 72 having a cylindrical portion 74 and rounded end portions 76 at each end and a seam 78 extending around the capsule to join the two portions 80 and 82.

Figure 6:
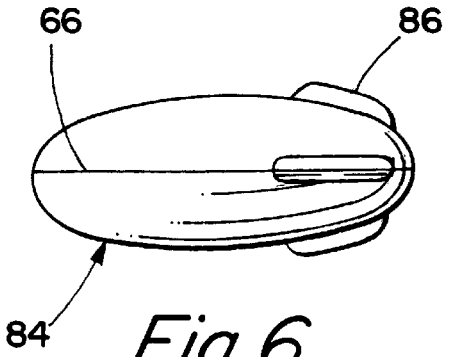
FIG. 6 shows a capsule having protrusions at one end.

FIG. 6A shows a capsule 84 having at one end protrusion 86.

Figure 7:
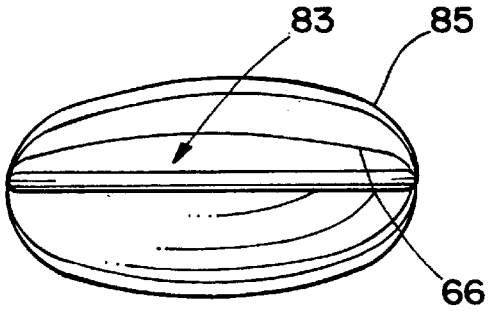
FIG. 7 shows a capsule having ridges.

FIG. 7 shows a capsule 83 having ridges 85 extending along its length dimension.

Figure 8:
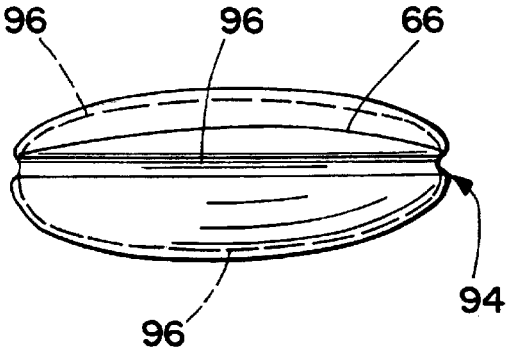
FIG. 8A shows a side view of a capsule having creases.
FIG. 8B shows an end view of a capsule having creases.
Figure 8A:
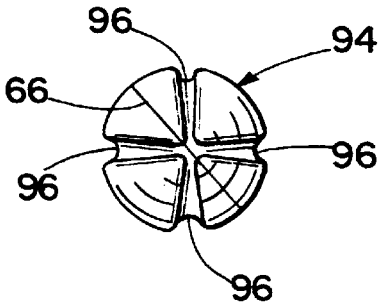

FIG. 8A and FIG. 8B shows a capsule 94 having creases 96.

Figure 9:
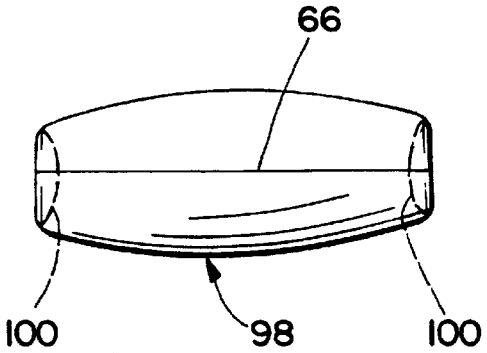
FIG. 9 shows a capsule having an indentation at each end.

FIG. 9 shows a capsule 98 having indentations 100 at each end, although there could be an indentation at only one end.

Figure 10:
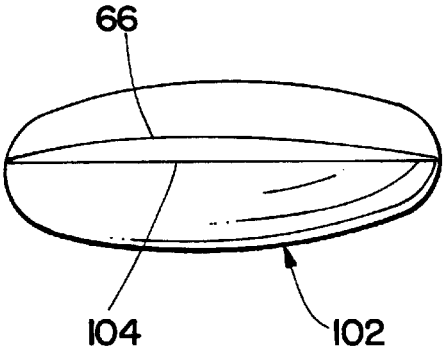
FIG. 10 shows a capsule having score lines.

FIG. 10 shows a capsule 102 having score lines, one being shown at 104. A score line is a thin shallow interruption in the plan surface of the capsule. Each of the capsules in FIGS. 5A–10 has a seam line —66—. The seam line 66 will not always be visible, or may only be slightly visible.

Various other modifications, changes, alterations and additions can be made in the improved projectile of the present invention, its components and their parameters. All such modifications, changes, alterations and additions as are within the scope of the appended claims form part of the present invention, which is defined by the appended claims construed in light of the specification and claims.

As stated above, one of the benefits of the invention is to accomplish rupturing of the capsule on, along or adjacent to the seam line. This includes some variability in where the weakening is present which may be directly along or at the seam, or adjacent the seam. The term to include the entire area where the weakening is considered to be present is defined as an area including the seam and adjacent the seam.

What is claimed is:

1. An improved soft, elastic, hollow, elongated capsule for propelling from a barrel having a bore diameter and a length comprising a plurality of portions joined along a substantially continuous seam line between adjoining portions of said capsule, defining an area including said seam line and adjacent said seam line, said capsule having a length dimension and a width dimension in which the length dimension is greater than the width dimension, said length dimension defining end points of said capsule, said area including said seam line and adjacent said seam line passing substantially through said end points and said capsule being weaker in said area including said seam line and adjacent said seam line than in said plurality of portions, the capsule being alignable with said length dimension along the length of the barrel and said area including said seam line and adjacent said seam line being alignable with the length of the barrel, whereby said capsule will substantially consistently impact on the area including said seam line and adjacent said seam line and said width dimension substantially fits the bore of the barrel, said capsule containing colored water-soluble fill material for ejection therefrom upon rupture of said capsule upon impact on a soft solid target.

2. The capsule as set forth in claim 1 wherein said fill material when dried is washable from human and animal skin, clothing, and the accessible general environment.

3. The capsule as set forth in claim 1 where in said capsule is substantially composed of elastic gelatin.

4. The capsule as set forth in claim 1 wherein said capsule is at least partially filled to retain a substantially stable configuration under normal storage and handling.

5. The capsule as set forth in claim 1 wherein said length dimension is substantially equal to 10 percent to 166 percent greater than said width dimension.

6. The capsule as set forth in claim 1 wherein said plurality of portions are two in number and wherein there is one said seam line.

7. The capsule as set forth in claim 2 wherein said capsule is substantially filled with said fill material.

8. The capsule as set forth in claim 1 wherein said capsule has a dry wall thickness, in said area including said seam line and adjacent said seam line substantially equal to 0.004 inch to 0.019 inch, a length substantially equal to 0.400 inches to 2.000 inches and the width dimension is substantially equal to 0.300 inches to 0.750 inches.

9. The capsule as set forth in claim 1 wherein said capsule defines an interior volume substantially equal to 0.011 cubic inches to 0.347 cubic inches.

10. The capsule as set forth in claim 1 wherein said capsule is substantially ellipsoidal in configuration.

11. The capsule as set forth in claim 10 wherein said capsule forms a substantially rounded point on at least one end.

12. The capsule as set forth in claim 1 wherein said capsule is substantially cylindrical in shape.

13. The capsule as set forth in claim 12 wherein said capsule forms a substantially rounded point on at least one end.

14. The capsule as set forth in claim 1 wherein said capsule is substantially oval in shape.

15. The capsule as set forth in claim 14 wherein said capsule forms a substantially rounded point on at least one end.

16. The capsule as set forth in claim 1 wherein said capsule defines an indentation in at least one end.

17. The capsule as set forth in claim 1 wherein said capsule includes at least one protrusion at at least one end.

18. The capsule as set forth in claim 1 wherein said capsule defines at least one crease therein.

19. The capsule as set forth in claim 1 wherein said capsule includes at least one ridge thereon.

20. The capsule as set forth in claim 1 wherein said capsule includes at least one score line therein.

21. The capsule as set forth in claim 1 wherein said capsule has a dry wall thickness in said area including said seam line and adjacent said seam line substantially equal to 0.020 inch to 0.030 inch, a length substantially equal to 0.40 inch to 2.00 inches, the width dimension is substantially equal to 0.30 to 0.75 inch.

22. The capsule as set forth in claim 1 wherein adjoining portions of said plurality of portions are joined at the seam line between them.

23. The capsule of claim 1 wherein said plurality of portions is two portions.

24. An improved, soft, elastic, hollow, elongated capsule for propelling from a barrel having a bore diameter and a length comprising at least two portions with at least one substantially continuous seam line between adjoining said portions, defining an area including said seam line and adjacent said seam line, said capsule having a maximum peripheral dimension in a length direction and a greatest width peripheral dimension in a width direction, said greatest width peripheral dimension being less than said maximum peripheral dimension and a centerline having two end points, such that a plane containing said maximum peripheral dimension also substantially contains said centerline, said area including said seam line and adjacent said seam line being generally disposed along said maximum peripheral dimension of said capsule and through said end points of said centerline and being the weakest part of the capsule, said centerline of said capsule being alignable along the length of the barrel, and said capsule having its greatest width peripheral dimension substantially fit the bore of the barrel whereby when fired said capsule will substantially consistently impact on said area including said seam line and adjacent said seam line, said capsule containing colored water-soluble fill material for ejection therefrom upon rupture of said capsule upon impact of said capsule on a target.

25. The capsule as set forth in claim 24 wherein said fill material when dried is washable from human and animal skin, clothing, and the accessible general environment.

26. The capsule as set forth in claim 24 wherein said capsule is substantially composed of elastic gelatin.

27. The capsule as set forth in claim 24 wherein said capsule is at least partially filled to retain a stable configuration under normal storage and handling.

28. The capsule as set forth in claim 24 wherein said plurality of portions are two in number and wherein there is one seam line.

29. The capsule as set forth in claim 25 wherein said capsule is substantially filled with said fill material.

30. The invention as set forth in claim 24 wherein said capsule has a dry wall thickness at or adjacent said at least one seam line, substantially equal to 0.004 inch to 0.19, a length substantially equal to 0.400 inches to 2.000 inches and the greatest width peripheral dimension being substantially equal to 0.300 inches to 0.750 inches.

31. The capsule as set forth in claim 24 wherein said capsule is substantially ellipsoidal in configuration.

32. The capsule as set forth in claim 31 wherein said capsule forms a substantially rounded point at at least one end.

33. The capsule as set forth in claim 24 wherein said capsule is substantially cylindrical in shape.

34. The capsule as set forth in claim 33 wherein said capsule forms a substantially rounded point at at least one end.

35. The capsule as set forth in claim 24 wherein said capsule is substantially oval in shape.

36. The capsule as set forth in claim 35 wherein said capsule forms a substantially rounded point at at least one end.

37. The capsule as set forth in claim 24 wherein said capsule defines an indentation at at least one end.

38. The capsule as set forth in claim 24 wherein said capsule includes at least one protrusion at at least one end.

39. The capsule as set forth in claim 24 wherein said capsule defines at least one crease therein.

40. The capsule as set forth in claim 24 wherein said capsule includes at least one ridge thereon.

41. The capsule as set forth in claim 24 wherein said capsule includes at least one score line therein.

42. The capsule as set forth in claim 24 wherein adjoining portions of said plurality of portions are joined at the seam line between them.

43. The capsule as set forth in claim 30 wherein said capsule defines an interior volume substantially equal to 0.011 cubic inches to 0.347 cubic inches.

44. The capsule as set forth in claim 24 wherein said maximum peripheral dimension in a length direction defines a length dimension of said capsule and said greatest width peripheral dimension in a width direction defines a greatest width dimension and said length dimension is substantially equal to 10 percent to 166 percent greater than said greatest width dimension.

45. The invention as set forth in claim 44 wherein said capsule has a dry wall thickness substantially adjacent said at least one seam line substantially equal to 0.004 inch to 0.030 inch.

46. The capsule as set forth in claim 24 wherein said capsule has a dry wall thickness in said area including said seam line and adjacent said seam line substantially equal to 0.020 inch to 0.030 inch, a length substantially equal to 0.400 inches to 2.000 inches and the greatest width peripheral dimension being substantially equal to 0.300 inches to 0.750 inches.

47. The capsule of claim 24 wherein said at least two portions is two portions.

48. A soft, elastic, hollow capsule for use in shooting at targets from a shooting device having a barrel with a bore diameter and an axis extending lengthwise of the barrel comprising:

a wall defining said capsule, said wall having at least one continuous seam line therein defining an area including the seam line and adjacent the seam line, the capsule being elongated to define a long periphery and a short periphery, the area including the seam line and adjacent the seam line extending substantially around said long periphery, and said short periphery being substantially circular having a dimension to operatively fit in the bore of the barrel for shooting therefrom with the area including the seam line and adjacent the seam line being alignable with the axis of the barrel, and said capsule containing colored water soluble fill material for ejection therefrom upon rupture of said capsule upon impact on a target.

49. The capsule as set forth in claim 48 wherein said capsule is substantially composed of elastic gelatin.

50. The capsule as set forth in claim 48 wherein said capsule is at least partially filled with fill material to retain a substantially stable configuration under normal storage and handling.

51. The capsule as set forth in claim 48 wherein said long periphery defines a length of said capsule and said short periphery defines a greatest width of said capsule and wherein said length of said capsule is substantially equal to 10 percent to 166 percent greater than said greatest width.

52. The capsule as set forth in claim 48 wherein said capsule comprises two portions joined along one seam line.

53. The capsule as set forth in claim 48 wherein capsule is substantially filled with said fill material.

54. The capsule as set forth in claim 48 wherein said capsule has a dry wall thickness, in said area including said seam line and adjacent said seam line substantially equal to 0.004 inch to 0.019 inch, said long periphery defines a length of said capsule and said short periphery defines a greatest width of said capsule and said length is substantially equal to 0.400 inches to 2.000 inches and said greatest width is substantially equal to 0.300 inches to 0.750 inches.

55. The capsule as set forth in claim 48 wherein said capsule is substantially ellipsoidal in configuration.

56. The capsule as set forth in claim 48 wherein said capsule is substantially cylindrical in shape.

57. The capsule as set forth in claim 48 wherein said capsule is substantially oval in shape.

58. The capsule as set forth in claim 48 wherein said capsule has a dry wall thickness, in said area including said seam line and adjacent said seam line, substantially equal to 0.020 inch to 0.030 inch, and said long periphery defines a length of said capsule and said short periphery defines a greatest width of said capsule and said length is substantially equal to 0.400 inch to 2.00 inches, and said greatest width is substantially equal to 0.300 to 0.750 inches.

59. The capsule as set forth in claim 48 wherein said capsule comprises a plurality of portions joined at said seam line.

60. The capsule as set forth in claim 48 wherein said capsule defines an interior volume substantially equal to 0.011 cubic inches to 0.347 cubic inches.

61. The capsule as set forth in claim 55 wherein said capsule forms a substantially rounded point at one end.

62. The capsule as set forth in claim 56 wherein said capsule forms a substantially rounded point on at least one end.

63. The capsule as set forth in claim 57 wherein said capsule forms a substantially rounded point on at least one end.

64. The capsule as set forth in claim 58 wherein said capsule defines an interior volume substantially equal to 0.011 cubic inches to 0.347 cubic inches.

65. A method of marking a target by impact of a capsule shot from a shooting device having a barrel with a bore diameter and an axis extending lengthwise of the barrel comprising:

loading into said barrel a soft, elastic, hollow capsule having a wall defining said capsule, said wall having at least one continuous seam line defining an area including the seam line and adjacent the seam line therein, the capsule being elongated to define a long periphery and a short periphery, the area including the seam line and adjacent the seam line extending substantially around said long periphery, and said short periphery being substantially circular having a dimension to operatively fit in the bore of the barrel for shooting therefrom with the seam line aligned with the axis of the barrel, and said capsule containing colored water soluble fill material for ejection therefrom upon rupture of said capsule upon impact on a target; and shooting said capsule at target.

66. The method as set forth in claim 65 wherein said capsule is substantially composed of elastic gelatin.

67. The method as set forth in claim 65 wherein said capsule is at least partially filled to retain a substantially stable configuration under normal storage and handling.

* * * * *